US005769758A

United States Patent [19]

Sarkinen

[11] Patent Number: 5,769,758

[45] Date of Patent: Jun. 23, 1998

[54] METHOD AND DEVICE FOR EXERCISING THE WRIST AND HAND

[76] Inventor: Stanley L. Sarkinen, 14803 NE. 212th Ave., Brush Prairie, Wash. 98606

[21] Appl. No.: 761,270

[22] Filed: Dec. 6, 1996

Related U.S. Application Data

[60] Provisional application No. 60/008,213, Dec. 15, 1995.

[51] Int. Cl. [6] ..... A63B 23/16

[52] U.S. Cl. ..... 482/44; 482/907; 601/40

[58] Field of Search ..... 482/44, 907; 5/646, 5/647; 601/40; 128/878, 879

[56] References Cited

U.S. PATENT DOCUMENTS 1,266,367 5/1918 Wilson ..... 5/646
4,596,240 6/1986 Takahashi et al. .
5,140,998 8/1992 Vickers ..... 5/646
5,256,136 10/1993 Sucher .

*Primary Examiner*—Lynne A. Reichard
*Attorney, Agent, or Firm*—Olson & Olson

[57] ABSTRACT

Exercising the wrist and hand of an individual is achieved solely by the individual by anchoring the hand to a fixed support with the palm facing upward and the thumb and fingers free to move. The individual then grasps the thumb of the secured hand by the other hand and pushes the thumb laterally outward and toward the fixed support, thereby stretching the muscles, tendons and ligaments of the hand. Anchoring the hand to a fixed support is achieved by use of a C-shaped clamp, with one open end engaging the underside of the fixed support and the other open end engaging the palm side of the hand in the area between the carpal wrist bones.

10 Claims, 2 Drawing Sheets

METHOD AND DEVICE FOR EXERCISING THE WRIST AND HAND

This application claims the benefit of Provisional application No. 60/008,213, filed 15 Dec. 1995.

BACKGROUND OF THE INVENTION

This invention relates to wrist and hand exercising, and more particularly to a method and device for achieving efficient and effective stretching of the muscles, tendons and ligaments of the wrist and hand.

Lack of adequate stretching of the muscles, tendons and ligaments of the wrist and hand can result in diminished capacity of useful function of the hand. One such deficiency is a condition known as carpal tunnel syndrome. This is a painful condition resulting from impinging of the median nerve that passes through a tunnel formed by the carpal wrist bones and a tough carpal ligament on the underside of the wrist that binds the bones together. As tissues within the tunnel swell, for whatever reason, they press on the median nerve and cause tingling and numbness of part of the hand, often accompanied by pains that shoot up the arm from the wrist.

Exercising of the wrist and hand to effect stretching of the muscles, tendons and ligaments, including the carpal ligament, generally is accomplished simply by self-manipulation, or by a second party, i.e. by flexing the wrist in all directions and by fanning and stretching the fingers. Various devices have been proposed heretofore to assist manual self-manipulation. One such type of device is a glove described in U.S. Pat. No. 5,256,136 wherein the internal construction of the glove serves to spread the palm and bend the fingers back. Another mechanical device is the ballonet described in U.S. Pat. No. 4,596,240 wherein the hand is secured to the outer side of a ballonet and the latter inflated and deflated with compressed air to effect extension and fanning of the hand and fingers. Such devices do not afford application of forces to the precise area and to the magnitude necessary to achieve optimum results.

SUMMARY OF THE INVENTION

This invention provides for the positive anchoring down of a part of the hand laterally opposite the thumb so that manual forcing of the thumb in the direction to open the palm is effective in stretching the muscles, tendons and ligaments, including the carpal ligament, to a significant degree.

It is the principal objective of this invention to provide for the exercising of the wrist and hand of a user by means which affords complete control of the magnitude of forces applied to the hand of the user, to avoid excessive pain and possible physical damage to the user.

Another objective of this invention is to provide for the exercising of the wrist and hand of a user without assistance from any other person.

Still another objective of this invention is the provision of a device by which a user is capable of effecting the exercising of the wrist and hand without assistance and with complete control of the limits of such exercising.

A further objective of this invention is to provide a wrist and hand exercising device which is incapable of being applied to the hand in a manner which would produce damage or pain.

A still further objective of this invention is to provide a wrist and hand exercising device of simplified construction for economical manufacture.

The foregoing and other objects and advantages of this invention will appear from the following detailed description, taken in connection with the accompanying drawings of preferred embodiments.

DESCRIPTION OF THE PREFERRED EMBODIMENTS

Figure 1:
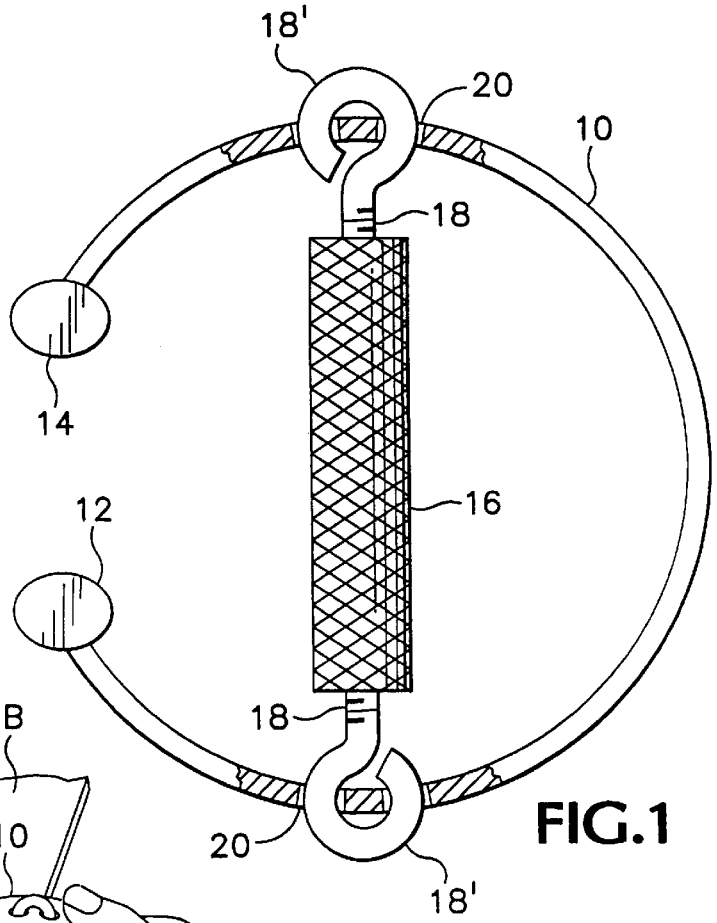
FIG. 1 is a side view of a wrist and hand exercising device embodying features of this invention, portions being broken away to disclose internal detail.

FIG. 1 shows one embodiment of a wrist and hand exercising device for such use as stretching the carpal and other ligaments, muscles and tendons of the hand. The device is illustrated in the form of a C-clamp of an open circular band 10 of spring steel or other suitable material. The open ends of the band are terminated in laterally elongated contacts 12 and 14. Contact 14 is of circular, oval, or other elongated cylindrical cross section and preferably is knurled or otherwise roughened to provide frictional contact with the palm side of a hand to be exercised. Contact 12 preferably is a head of round or slightly oval cross section and need not have a roughened surface since it merely engages the underside of a table top or other fixed base.

A turnbuckle, formed of a rotatable, internally threaded, externally knurled or otherwise roughened handle 16 and oppositely projecting threaded screws 18, is secured pivotally at the outer ends of the screws, as by the loops 18' extending through base openings 20 at diametrically opposite sides of the band 10.

Figure 2:
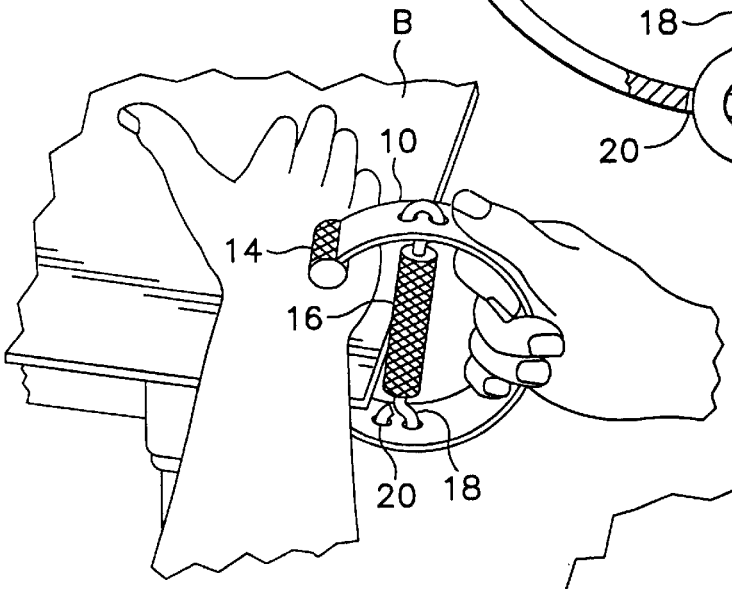
FIG. 2 is a fragmentary perspective view showing the device of FIG. 1 in initial position securing a left hand to a fixed table top by manipulation of the device with the right hand.

FIG. 2 of the drawings shows a left hand of a user resting palm-side up on a fixed base B, such as the illustrated table top, at the corner thereof, with open end contact 12 of the C-clamp of FIG. 1 engaging the underside of the table top and the opposite open end roughened contact 14 frictionally engaging the palm side of the hand just inwardly of and extending substantially parallel to the fingers and lateral side of the hand opposite the thumb.

By rotating the handle portion 16 of the turnbuckle, the distance between the open contact ends 12 and 14 may be varied, to accommodate various thicknesses of hands and table tops, or other suitable form of fixed base upon which to rest the hand. This is accompanied by pivoting of the turnbuckle at the loops 18'. The turnbuckle is adjusted so that the open contact end 14 of the C-clamp engaging the hand bears positively and with compressive pressure upon the portion of the carpal wrist bones that are laterally opposite the thumb. Since the turnbuckle handle cannot be manipulated when the hand is under the contact 14, the adjustment for compression is by trial and error with intermittent fittings of the hand. This insures against applying excessive compressive pressure on the carpal wrist bones.

With the hand thus held positively against the table top or other fixed base, palm-up, the other, right hand grasps the thumb of the clamped left hand and pushes it horizontally outward away from the opposite lateral side of the hand and slightly downward toward the fixed base, against the resistance of the carpal ligament.

Figure 3:
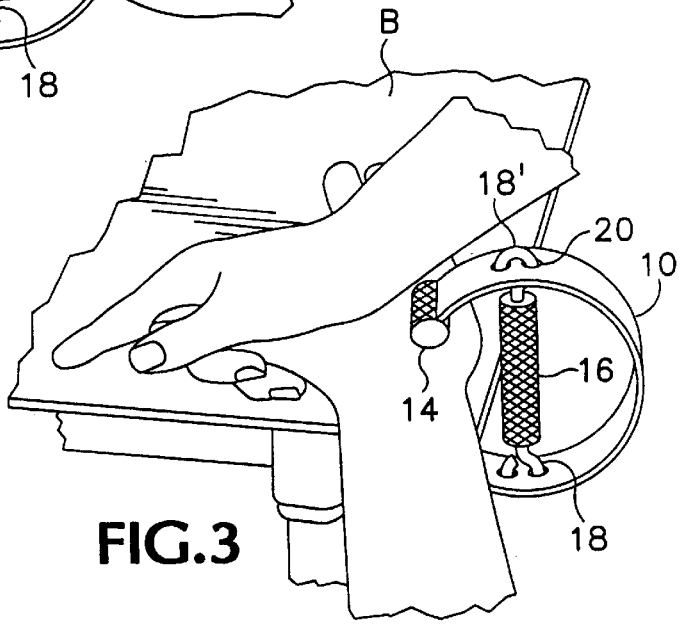
FIG. 3 is a fragmentary perspective view showing the device of FIG. 1 shifted from the initial position in FIG. 2 to final position still securing the left hand to the fixed table top but with the right hand grasping the left hand thumb and pushing it horizontally outward and somewhat downward toward the table top, to stretch the muscles, tendons and ligaments of the wrist and hand.

As the thumb is pushed horizontally outward away from the opposite side of the hand, the hand tends to move in the direction of the thumb. This is accommodated by the C-clamp rocking on the rounded end 12 engaging the underside of the table, as shown by comparison of FIGS. 2 and 3. The horizontally outward and downward pressure on the thumb opens the palm of the hand and stretches the muscles, tendons and ligaments of the hand, including the carpal ligament, whereby to open the carpal tunnel and relieve painful compression pressure on the median nerve. This procedure, approximately twice a week, is recommended.

The rocking of the C-clamp as the hand moves toward the thumb also moves the contact end 14 closer to the table top, bringing added compressive force on the underlying wrist bone area of the hand. This serves as a safety factor in providing a pain warning of excessive pressure on the thumb.

Figure 4:
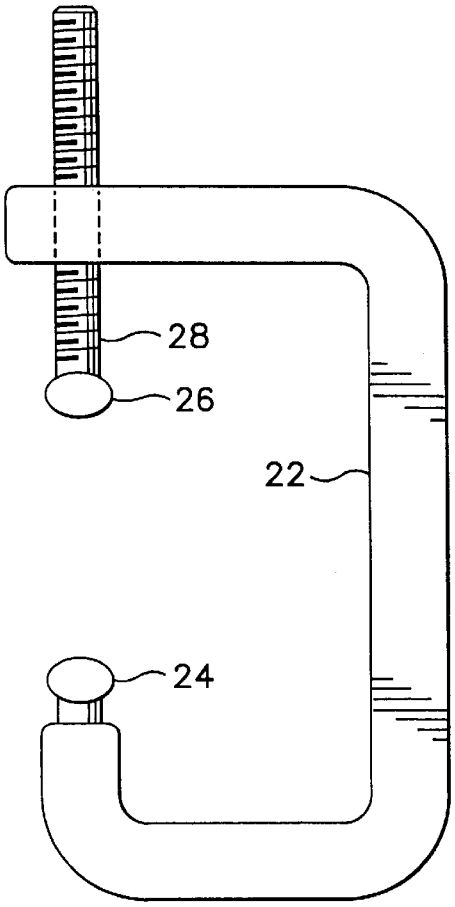
FIGS. 4, 5 and 6 are side views of further embodiments of the wrist and hand exercising device embodying the features of this invention.

FIG. 4 illustrates a second embodiment of the C-clamp device. In this embodiment a conventional C-clamp 22 is modified to include a rounded contact head 24 on the fixed end of the C-clamp body, to allow rocking of the C-clamp, and a roughened, elongated cylindrical contact head 26 on the confronting end of the threaded rod 28, to engage the palm side of a hand to be exercised. Since the head 26 engages the hand, the rod 28 must be adjusted on the same trial and error basis as previously described, to prevent excessive pressure on the wrist bones.

Figure 5:
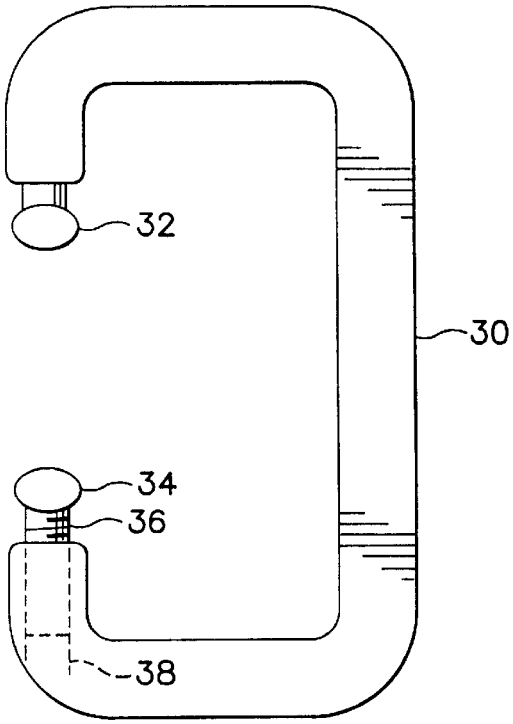

In FIG. 5, a C-shaped clamp body 30 is provided with a roughened, elongated cylindrical contact head 32 on the open end of the body arranged for engaging the palm side of a hand to be treated, and rounded contact head 34 is provided on the end of an elongated screw 36 engaging a threaded bore 38 in the open end of the body arranged for engaging the underside of a table top or other fixed base. Trial and error adjustment of the screw 36 is required to achieve desired pressure on the wrist bones.

Figure 6:
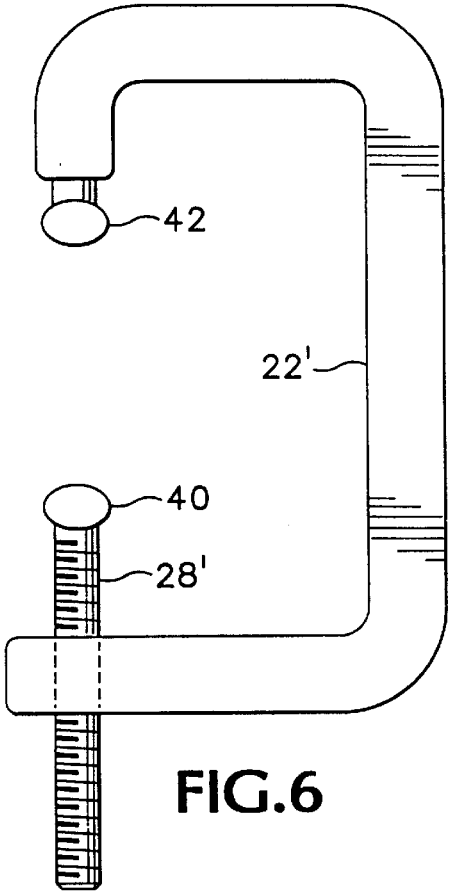

FIG. 6 is similar to FIG. 4, with the C-clamp body 22' reversed end-for-end with the threaded rod 28' extending downward under a table top or other fixed base. In this arrangement the rod 28' is provided with a rounded contact head 40 for engaging the underside of a fixed base and the upper, open end of the body 22' is provided with a roughened, elongated cylindrical contact head 42 for engaging the palm side of a hand to be treated. Like the screw 36 of FIG. 5, the screw 28' requires trial and error adjustment to achieve desired pressure on the wrist bones.

It will be apparent to those skilled in the art that various changes may be made in the size, shape, type, number and arrangement of parts described hereinbefore. For example, the rounded heads 12, 24, 34 and 40 may be replaced with elongated cylindrical contact heads, provided they are arranged with their longitudinal dimension extending perpendicular to the plane of the C-clamp body, to enable the rocking action described. They also may be roughened, if desired. Although positioning the arm of a person to be treated at any position over a table top or other fixed base is acceptable, locating it at a corner of a table top or other elevated fixed base is preferred, since it allows the lower arm of the person to extend outward of the base and angularly downward therefrom, to further open the palm. These and other changes may be made without departing from the spirit of this invention.

I claim:

1. The method of exercising the wrist and hand, comprising:

a) anchoring the back of the hand substantially immovably to a fixed support with the thumb disposed for movement by applying pressure on the palm side of the hand in the area of the carpal wrist bones laterally opposite the thumb, and b) grasping the thumb and manually forcing it in the direction away from the opposite side of the hand to open and stretch the carpal ligament of the upwardly facing palm.

2. The method of claim 1 wherein the anchoring of the back of the hand is achieved by clamping the hand between a pair of clamping members one of which engages the underside of a fixed support and the other of which engages the palm side of the hand in the carpal tunnel area between the thumb and the side laterally opposite the thumb.

3. The method of claim 1 wherein the anchoring of the back of the hand is achieved by clamping the hand between a pair of clamping members one of which is movable toward and away from the other and one of which engages the underside of a fixed support and the other of which engages the palm side of a hand in the carpal tunnel area between the thumb and the side laterally opposite the thumb.

4. A device for exercising the wrist and hand of a user, comprising:

a) a C-shaped body member having spaced apart ends, b) adjustable means on the C-shaped body member for moving one of said spaced apart ends toward and away from the other of said spaced apart ends, c) one of said spaced apart ends of the C-shaped body member being arranged to abut the underside of a fixed support, and d) the other of said spaced apart ends of the C-shaped body member being located below the top end of the C-shaped body and configured to engage the palm side of a hand, between the thumb and opposite lateral side thereof, in the carpal tunnel area, with the hand positioned palm side up on the fixed support, e) the adjustable means being operable to move the spaced apart ends of the C-shaped body member one toward and away from the other to apply pressure on the palm side of the hand in the carpal tunnel area to secure a hand against the fixed support.

5. The device of claim 4 wherein the said other of said spaced apart ends is elongated in the direction perpendicular to the plane through the C-shaped body member to engage in the carpal tunnel area and extend toward the fingers of a hand engaged by said elongated end.

6. The device of claim 4 wherein the said other of said spaced apart ends is secured non-rotatably to a threaded rod extending through a threaded bore in the C-shaped body member.

7. The device of claim 4 wherein the said one of said spaced apart ends is on one end of a threaded rod received in a threaded bore in the C-shaped body member, and the said other of said spaced apart ends is elongated for extending perpendicular to the plane through the C-shaped body member.

8. The device of claim 4 wherein the said other of said spaced apart ends has a roughened surface for frictionally engaging the hand.

9. The device of claim 4 wherein the said one of said spaced apart ends is configured to afford rocking of the C-shaped body member relative to the fixed support.

10. A device for exercising the wrist and hand of a user, comprising:

a) a C-shaped body member having spaced apart ends, b) a turntable member secured at its opposite ends to substantially diametrically opposite positions of the C-shaped body member and extending across the C-shaped body member substantially parallel to the plane through the spaced part ends, the turnbuckle member being operable to move the spaced apart ends toward and away from each other, c) one of said spaced apart ends of the C-shaped body member being arranged to abut the underside of a fixed support, and d) the other of said spaced apart ends of the C-shaped body member being configured to engage the palm side of a hand, between the thumb and opposite side thereof, with the hand positioned palm side up on the fixed support, e) the turntable member being operable to move the spaced apart ends of the C-shaped body member one toward and away from the other to secure the hand against the fixed support.

* * * * *